US008199941B2

(12) United States Patent
Hudson et al.

(10) Patent No.: US 8,199,941 B2
(45) Date of Patent: Jun. 12, 2012

(54) METHOD OF IDENTIFYING SPEAKERS IN A HOME THEATER SYSTEM

(75) Inventors: Michael D. Hudson, Portland, OR (US); Kelly M. McArthur, Hillsboro, OR (US); Richard S. Liebelt, Beaverton, OR (US); John W. Klinker, Portland, OR (US)

(73) Assignee: Summit Semiconductor LLC, San Jose, CA (US)

( * ) Notice: Subject to any disclaimer, the term of this patent is extended or adjusted under 35 U.S.C. 154(b) by 211 days.

(21) Appl. No.: 12/489,322

(22) Filed: Jun. 22, 2009

(65) Prior Publication Data

US 2009/0323991 A1 Dec. 31, 2009

Related U.S. Application Data

(60) Provisional application No. 61/074,899, filed on Jun. 23, 2008, provisional application No. 61/074,906, filed on Jun. 23, 2008, provisional application No. 61/074,910, filed on Jun. 23, 2008, provisional application No. 61/074,914, filed on Jun. 23, 2008.

(51) Int. Cl.
*H04R 5/02* (2006.01)
*H04R 29/00* (2006.01)

(52) U.S. Cl. ..... 381/303; 381/58; 381/59; 381/27

(58) Field of Classification Search ..... 381/27, 381/58–59, 77, 79, 17–19, 96, 300, 303–305, 381/124; 367/137, 138, 118, 120–122, 127–129
See application file for complete search history.

(56) References Cited

U.S. PATENT DOCUMENTS

| | | | | |
|---|---|---|---|---|
| 5,386,478 | A * | 1/1995 | Plunkett | 381/103 |
| 5,666,424 | A * | 9/1997 | Fosgate et al. | 381/18 |
| 7,123,731 | B2 * | 10/2006 | Cohen et al. | 381/303 |
| 7,155,017 | B2 * | 12/2006 | Kim et al. | 381/59 |
| 7,158,643 | B2 * | 1/2007 | Lavoie et al. | 381/58 |
| 7,272,073 | B2 * | 9/2007 | Pellegrini et al. | 367/124 |
| 7,319,641 | B2 * | 1/2008 | Goudie et al. | 367/138 |
| 7,676,044 | B2 * | 3/2010 | Sasaki et al. | 381/59 |
| 2007/0133813 | A1 * | 6/2007 | Morishima | 381/59 |

FOREIGN PATENT DOCUMENTS

WO WO 2006/131893 * 12/2006

* cited by examiner

*Primary Examiner* — Xu Mei
(74) *Attorney, Agent, or Firm* — Chernoff, Vilhauer, McClung & Stenzel

(57) ABSTRACT

With an array of speakers including a center speaker provided with left and right ultrasonic electro-acoustic transducers and left and right speakers provided with respective ultrasonic electro-acoustic transducers, it is possible to identify the left and right speakers. One approach includes energizing the left transducer of the center speaker to emit an acoustic ping signal, utilizing the transducers of the left and right speakers to detect the ping signal, measuring lapse of time between emission of the ping signal by said the left transducer and detection of the ping signal by the transducers of the left and right speakers. Then, the right transducer of the center speaker is energized to emit an acoustic ping signal, the transducers of the left and right speakers are utilized to detect the ping signal, and lapse of time between emission of the ping signal by the right transducer and detection of the ping signal by the transducers of the left and right speakers is measured.

13 Claims, 3 Drawing Sheets

METHOD OF IDENTIFYING SPEAKERS IN A HOME THEATER SYSTEM

CROSS-REFERENCE TO RELATED APPLICATION

This application claims benefit of U.S. Provisional Applications No. 61/074,899, 61/074,906, 61/074,910 and 61/074,914, all filed Jun. 23, 2008, the entire disclosure of each which is hereby incorporated herein by reference for all purposes.

BACKGROUND OF THE INVENTION

The subject matter of this application relates to a method of identifying speakers in a home theater system.

A typical home theater system comprises a display unit, a DVD player or other signal source, an audio video control receiver, and multiple speakers. A so-called 7.1 channel system uses eight speakers, namely a center speaker, a subwoofer and six surround speakers (right and left front, right and left fill and right and left rear). The home theater system includes a home theater decoder which creates eight digital audio signals, which are assigned to the eight speakers respectively, from data that the DVD player reads from the disk. We will assume for the purpose of this discussion that the home theater decoder is integrated in the DVD player but it could be elsewhere in the system.

The home theater decoder combines the digital audio signals in four pairs, each pair running on an I2S serial bus. The I2S serial bus signal is composed of a succession of frames, each of which contains 32 left channel bits followed by 32 right channel bits. The labeling of the two groups of 32 bits as left channel and right channel is conventional but arbitrary, in that there is no industry standard that requires the left channel component of a two-channel audio signal to be encoded in the first group of bits of the I2S frame and the corresponding right channel component to be encoded in the second group of bits of the I2S frame. In a 7.1 channel home theater decoder having four I2S buses, I2S bus 0 might convey the signals created for the right front and left front speakers, bus 1 might convey the signals for right fill and left fill, bus 2 the signals for right rear and left rear, and bus 3 the signals for center and subwoofer. However, there is no industry standard for mapping speaker position to I2S bus channel. The DVD player transmits the four I2S serial bus signals over a digital communication medium to the receiver, which separates the four two-channel signals to generate eight digital audio signals and converts the digital audio signals to analog form for driving the eight speakers respectively. The system may employ wired speaker connections, in which case the receiver has at least eight pairs of speaker terminals from which wires run to the eight speakers respectively.

The subwoofer conveys low frequency information and the placement of the subwoofer and the timing of the audio signal for driving the subwoofer are not critical to satisfactory operation of the home theater system. However, optimum performance of the home theater system requires that the acoustic signals received from the other seven speakers at a listening location have the proper timing relationships, and consequently the receiver includes a facility for selectively delaying the audio signals supplied to the speakers to achieve the proper timing relationships among the acoustic signals.

The procedures for proper adjustment of the audio signal delays are so challenging to many would-be users of home theater systems that a large proportion of the receivers and multi-channel speaker systems that are purchased are returned to the stores without ever being properly installed.

SUMMARY OF THE INVENTION

In accordance with a first aspect of the disclosed subject matter there is provided a method of identifying speakers in an array comprising a center speaker, a left speaker, and a right speaker, the method comprising providing the center speaker with left and right ultrasonic electro-acoustic transducers, providing the left speaker and the right speaker each with an ultrasonic electro-acoustic transducer, and either (a) energizing one transducer of the center speaker to emit an acoustic ping signal, utilizing the transducers of the left and right speakers to detect the ping signal, measuring lapse of time between emission of the ping signal by said one transducer and detection of the ping signal by the transducers of the left and right speakers, energizing the other transducer of the center speaker to emit an acoustic ping signal, utilizing the transducers of the left and right speakers to detect the ping signal, and measuring lapse of time between emission of the ping signal by said other transducer and detection of the ping signal by the transducers of the left and right speakers, or (b) energizing the transducer of the left speaker to emit an acoustic ping signal, utilizing the transducers of the center speaker to detect the ping signal, measuring lapse of time between emission of the ping signal by the transducer of the left speaker and detection of the ping signal by the transducers of the center speaker, energizing the transducer of the right speaker to emit an acoustic ping signal, utilizing the transducers of the center speaker to detect the ping signal, and measuring lapse of time between emission of the ping signal by the transducer of the right speaker and detection of the ping signal by the transducers of the center speakers, and employing the measured values of lapse of time to assign a location to each of the left and right speakers relative to the center speaker.

In accordance with a second aspect of the disclosed subject matter there is provided a method of identifying speakers in an array comprising a center speaker, multiple A speakers, and multiple B speakers, where one of A and B is left and the other of A and B is right, wherein the A speakers include a front A speaker that is the closest of the A speakers to the center speaker, the center speaker includes A and B ultrasonic electro-acoustic transducers and each of the A speakers and each of the B speakers includes an ultrasonic electro-acoustic transducer, wherein the A transducer of the center speaker is closer than the B transducer to at least one of the A speakers and the B transducer of the center speaker is closer than the A transducer to at least one of the B speakers, and the method includes energizing the A transducer of the center speaker to emit an acoustic ping signal, utilizing the transducers of the A speakers to detect the ping signal, and measuring lapse of time between emission of the ping signal by the A transducer and detection of the ping signal by the transducers of the A and B speakers and energizing the B transducer of the center speaker to emit an acoustic ping signal, utilizing the transducers of the A speakers to detect the ping signal, and measuring lapse of time between emission of the ping signal by the B transducer and detection of the ping signal by the transducers of the A and B speakers.

In accordance with a third aspect of the disclosed subject matter there is provided a home theater system comprising a control unit including a radio transceiver for emitting and receiving wireless control signals and wireless left and right audio signals, a center speaker provided with left and right ultrasonic electro-acoustic transducers and with a center speaker control means for controlling the left and right electro-acoustic transducers in response to wireless control signals received from the radio transceiver, a first surround speaker provided with an ultrasonic electro-acoustic transducer and with a first speaker control means for controlling the electro-acoustic transducer of the first surround speaker in response to wireless control signals received from the radio transceiver, and a second surround speaker provided with an ultrasonic electro-acoustic transducer and with a second speaker control means for controlling the electro-acoustic transducer of the second surround speaker in response to wireless control signals received from the radio transceiver, and wherein the control unit, the center speaker control means, the first speaker control means and the second speaker control means are programmed so that when one of the surround speakers is in a right surround location relative to the center speaker and the other surround speaker is in a left surround location relative to the center speaker, the control unit cooperates with the center speaker control means, the first speaker control means and the second speaker control means to identify which of the first and second surround speakers is in the right surround location and which surround speaker is in the left surround location, and the control unit transmits the wireless left and right audio signals to the surround speakers in the left and right surround locations respectively.

In accordance with a fourth aspect of the disclosed subject matter there is provided a home theater system comprising a control unit including a radio transceiver for emitting and receiving wireless control signals and wireless left and right audio signals, a first speaker provided with an ultrasonic electro-acoustic transducer and with a first speaker control means for controlling the electro-acoustic transducer of the first speaker in response to wireless control signals received from the radio transceiver, and a second speaker provided with an ultrasonic electro-acoustic transducer and with a second speaker control means for controlling the electro-acoustic transducer of the second speaker in response to wireless control signals received from the radio transceiver, and wherein the control unit, the first speaker control means and the second speaker control means are programmed so that when one of the speakers is in a right location relative to a listening location and the other speaker is in a left location relative to the listening location, the control unit cooperates with the first speaker control means and the second speaker control means to determine distance between the first and second speakers, and the control unit transmits the wireless left and right audio signals to the left and right speakers respectively.

In accordance with a fifth aspect of the disclosed subject matter there is provided speaker that is suitable for use as a center speaker in an array of speakers that also includes multiple left speakers and multiple right speakers, wherein the speaker includes left and right ultrasonic electro-acoustic transducers for emitting an ultrasonic ping signal, wherein the left and right transducers are positioned so that when the speaker is utilized as a center speaker in an array that also includes a front left speaker and a front right speaker, the left transducer is closer than the right transducer to the front left speaker and the right transducer is closer than the left transducer to the right front speaker.

In accordance with a sixth aspect of the disclosed subject matter there is provided a method of optimizing a speaker system that includes a center speaker, multiple left speakers and multiple right speakers for a listener at a selectively variable location, wherein each speaker includes an ultrasonic electro-acoustic transducer, the method comprising positioning a portable location measurement device including an ultrasonic electro-acoustic transducer at a selected location and using the portable location measurement device to initiate a measurement procedure by which the transducers of at least two speakers emit ultrasonic ping signals, the transducer of the location measurement device detects the ultrasonic ping signals, and lapse of time between emission of the ping signal and detection of the ping signal by the transducer of the location measurement device is measured, allowing calculation of the position of the measurement location device relative to the speakers, whereby relative signal delays to the speakers may be adjusted to account for the position of the location measurement device.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

As used in this detailed description and in the appended claims, the term "audio" as applied to a signal means a signal having a frequency within the accepted standard range of audible frequencies, i.e. from 20 Hz to 20,000 Hz, whereas "ultrasonic" as applied to a signal means a signal having a frequency higher than 20 kHz. As applied to an electro-acoustic transducer, the term "ultrasonic" as used herein means that the transducer is able to emit and receive ultrasonic acoustic signals.

Figure 1:
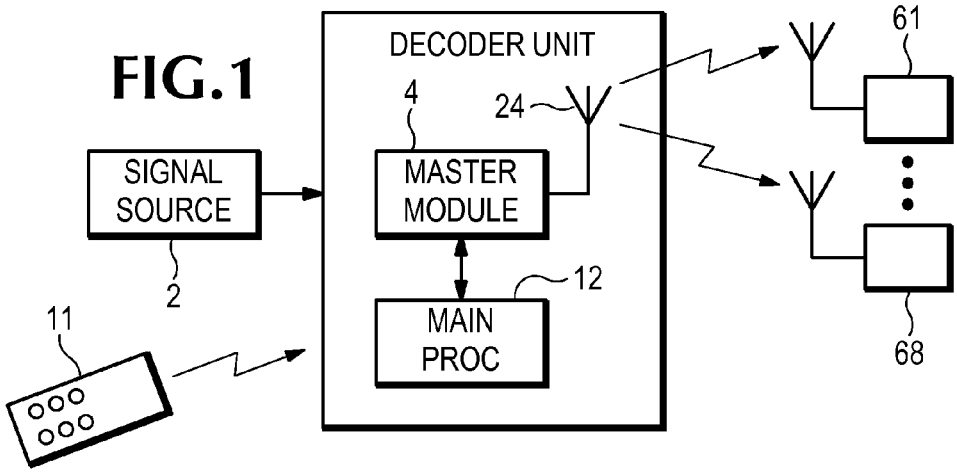
FIG. 1 is a schematic block diagram of a 7.1 channel home theater audio system embodying the subject matter disclosed in this application.

The 7.1 channel home theater system shown in FIG. 1 comprises a signal source 2, which may, for example, be a satellite receiver, a cable TV decoder or a DVD player, eight speakers 61-68 (a center speaker 61, six surround speakers 62-67 and a subwoofer 68) and a display unit 8. The home theater system also includes a home theater decoder 14 (FIG. 3), which receives audio data from the signal source and generates four I2S serial bus signals, as described above. The home theater decoder may be installed in, for example, the display unit, the DVD player or an audio video control receiver (AVR), or it may be a stand-alone unit. We will refer to the component in which the home theater decoder is installed as the decoder unit.

The decoder unit has a main processor 12, which controls the functions performed by the decoder unit, be it a display unit or an AVR, for example, in the home theater system. The main processor communicates with the home theater decoder 14 and a master module 4.

Figure 2:
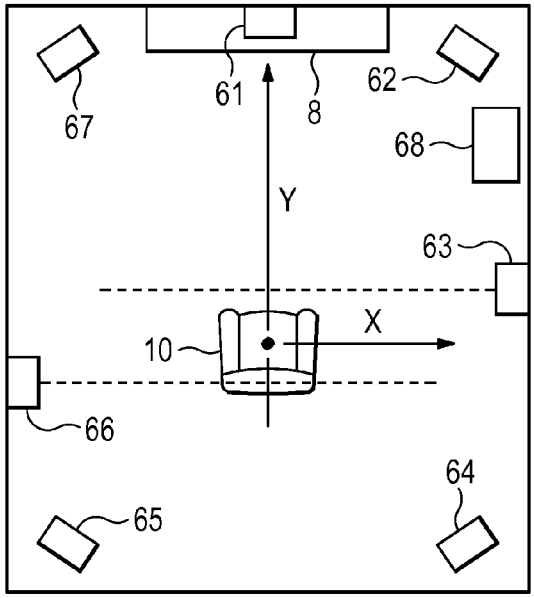
FIG. 2 is a plan view of a room in which the home theater system may be installed.

The home theater system is installed in a room having front, rear, left and right walls, with the display unit 8 against the front wall and the speakers 61-68 positioned as shown in FIG. 2 relative to the walls and a listening location 10. Generally, the user will interact with the home theater system using a hand-held remote control unit 11 that transmits user commands to an infrared receiver installed in the decoder unit. The IR receiver in the decoder unit passes the user commands to the main processor 12 and the main processor responds to the commands transmitted by the remote control unit. The main processor 12 communicates certain user commands to the master module 4.

Figure 3:
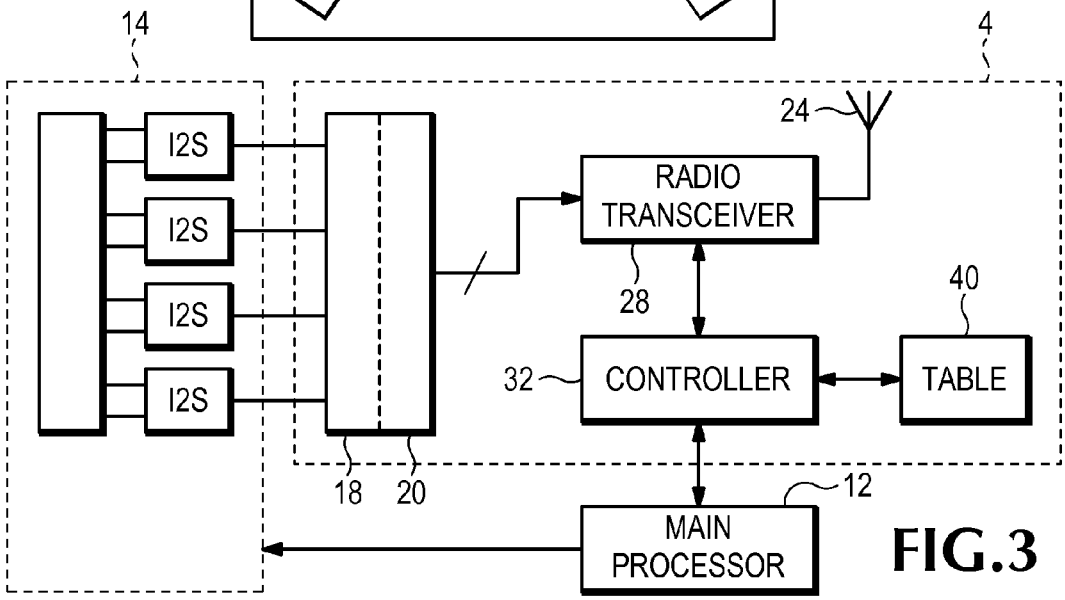
FIG. 3 is a more detailed block diagram illustrating parts of the decoder unit of the system shown in FIG. 1, FIG. 4A and FIG. 4B (collectively referred to as FIG. 4) are, respectively, a horizontal sectional view and a front elevation of one form of speaker used in the system shown in FIG. 1.

Referring to FIG. 3, the master module 4 also includes an antenna 24 for wireless transmission and reception of signals, a radio transceiver 28 that is able to transmit and receive on any selected one of several channels, a controller 32 that receives signals from the main processor and controls operation of the radio transceiver, and a non-volatile memory 40.

As discussed in detail below, the master module employs the radio transceiver 28 and antenna 24 for wireless transmission of audio signals provided by the home theater decoder 14 to the speakers. Accordingly, there is no need to run individual speaker wires to the speakers.

The center speaker and the six surround speakers are sometimes referred to herein as the main speakers. The six surround speakers are essentially identical to each other. The installer places the six surround speakers (in the 7.1 channel system under discussion) at selected positions in the room. Since the six surround speakers are identical, they are interchangeable and the installer can place the speakers without regard to whether a particular speaker is at a given location. In this specification, the term "location," as applied to a speaker, refers to the general location of the speaker relative to the listening location, e.g. front right, left rear, whereas the term "position" refers to the spatial position of the speaker expressed in units of linear (and possibly angular) displacement in a coordinate system having at least two axes.

Figure 4A:
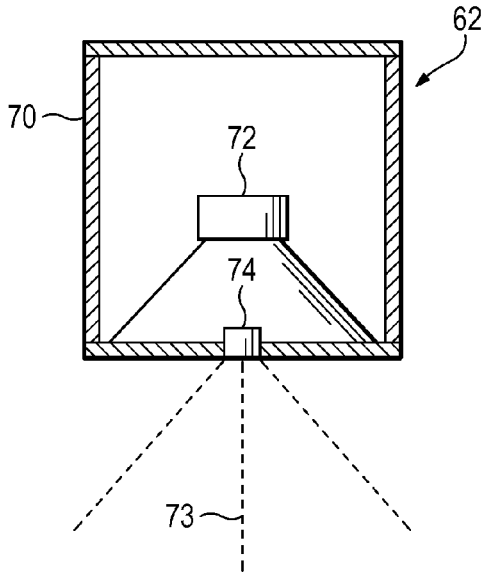
Figure 4B:
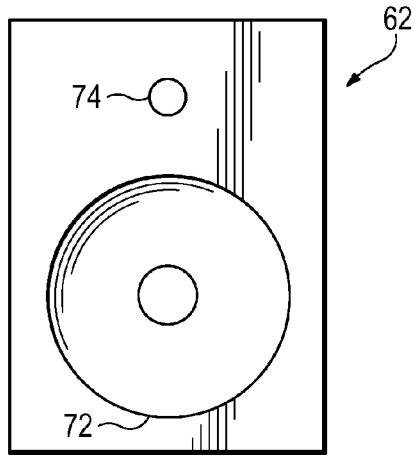

We will discuss the six surround speakers by reference to the speaker 62, which is placed in the front right location, i.e. in front of and to the right of the listening location 10. Referring to FIG. 4, the speaker 62 comprises a housing 70 and an audio driver 72. The housing is substantially symmetrical about a vertical plane 73. Typically, the speaker will be oriented so that the plane 73 extends towards the listening location 10. The driver 72 includes a diaphragm and a voice coil for displacing the diaphragm in response to an audio signal, thereby causing the driver to emit an audio frequency acoustic signal in a pattern that is substantially symmetrical about a horizontal axis that lies in the vertical plane 73 and is considered to be the central axis of the speaker. The speaker also comprises an electro-acoustic ultrasonic transducer 74 distinct from the audio driver 72. The transducer 74 is designed to emit and receive acoustic signals at ultrasonic frequencies, e.g. about 40 kHz, and has a relatively wide angle of sensitivity. For example, a typical inexpensive transducer, although rated as having an angle of sensitivity of 90°, may in fact be able to emit and receive over an angular range of 180° or more. The transducer is mounted in the housing so that the line defining the center of its angular range of sensitivity is parallel to, and vertically above, the central axis of the speaker.

Figure 5:
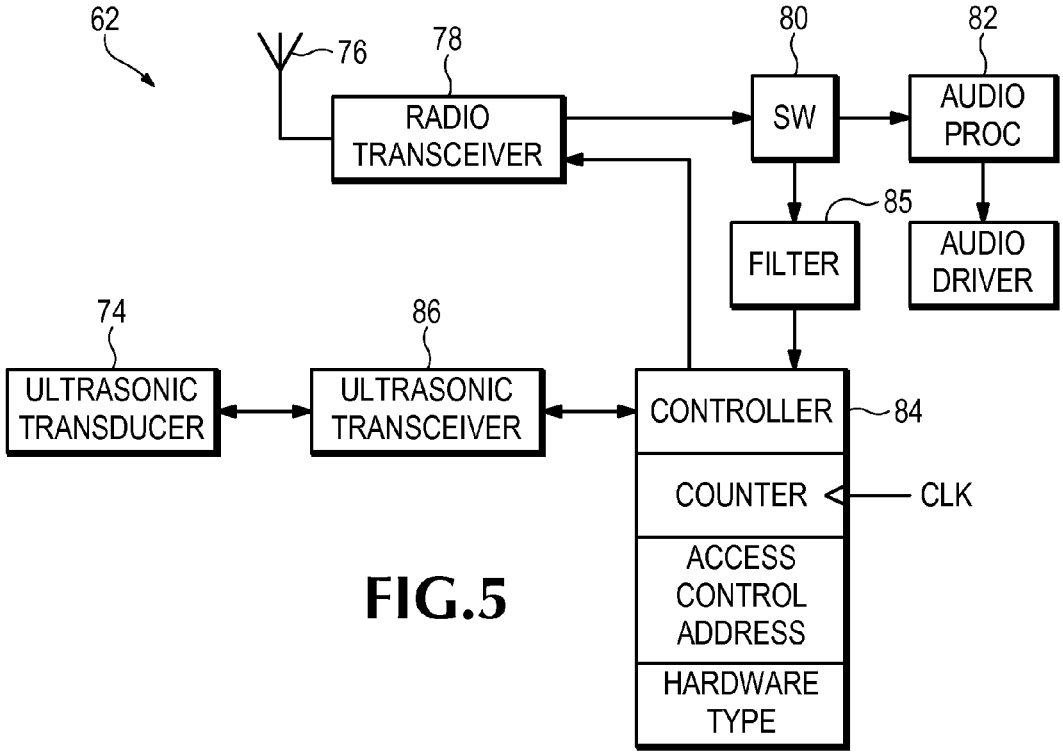
FIG. 5 is a schematic block diagram illustrating an electronics package included in the speaker shown in FIG. 4, FIG. 6A and FIG. 6B (collectively referred to as FIG. 6) are, respectively, a horizontal sectional view and a front elevation of a second form of speaker used in the home theater system shown in FIG. 1.

Referring to FIG. 5, the speaker 62 also includes an antenna 76 and an electronics package connected to a source of operating current. The electronics package includes a radio transceiver 78 connected to the antenna for receiving signals transmitted by the master module and transmitting signals to the master module, and a switch 80. The switch communicates a signal received from the radio transceiver 78 either to an audio processor 82 or to a controller 84 via a message filter 85. The electronics package also includes an ultrasonic transceiver 86, which is connected to the ultrasonic transducer.

The ultrasonic transceiver 86 responds to a command from the controller 84 by driving the ultrasonic transducer 74 to emit a brief ultrasonic signal at a frequency of about 40 kHz for about 250 μs (a ping). The signal power level may be quite high (over 100 dB) but because the signal is very brief it contains very little energy. When operating as a receiver, the ultrasonic transceiver provides a signal to the controller 84 when the transducer detects ultrasonic energy above a threshold level.

The controller 84 includes a counter that continuously counts clock pulses. The counter can be reset selectively to zero in response to a signal provided by the radio transceiver 78 and will store its count in response to a signal provided by the ultrasonic transceiver 86.

Figure 6A:
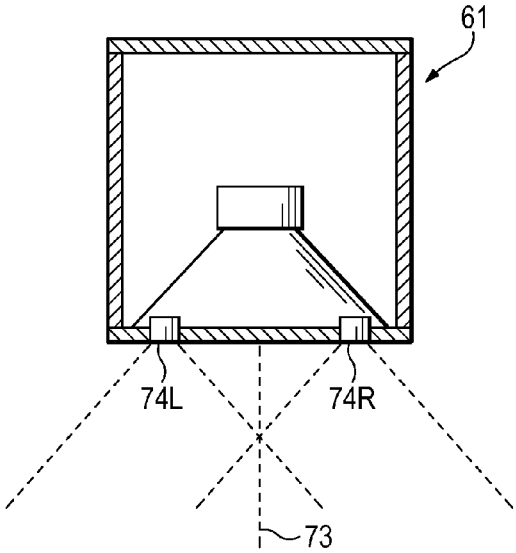
Figure 6B:
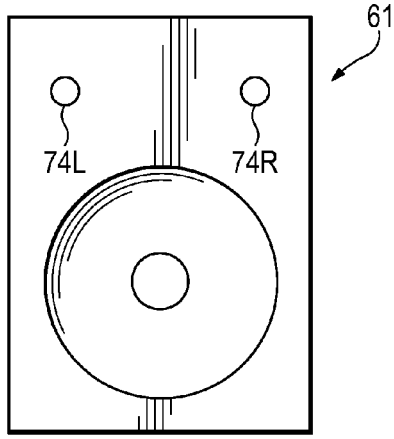
Figure 7:
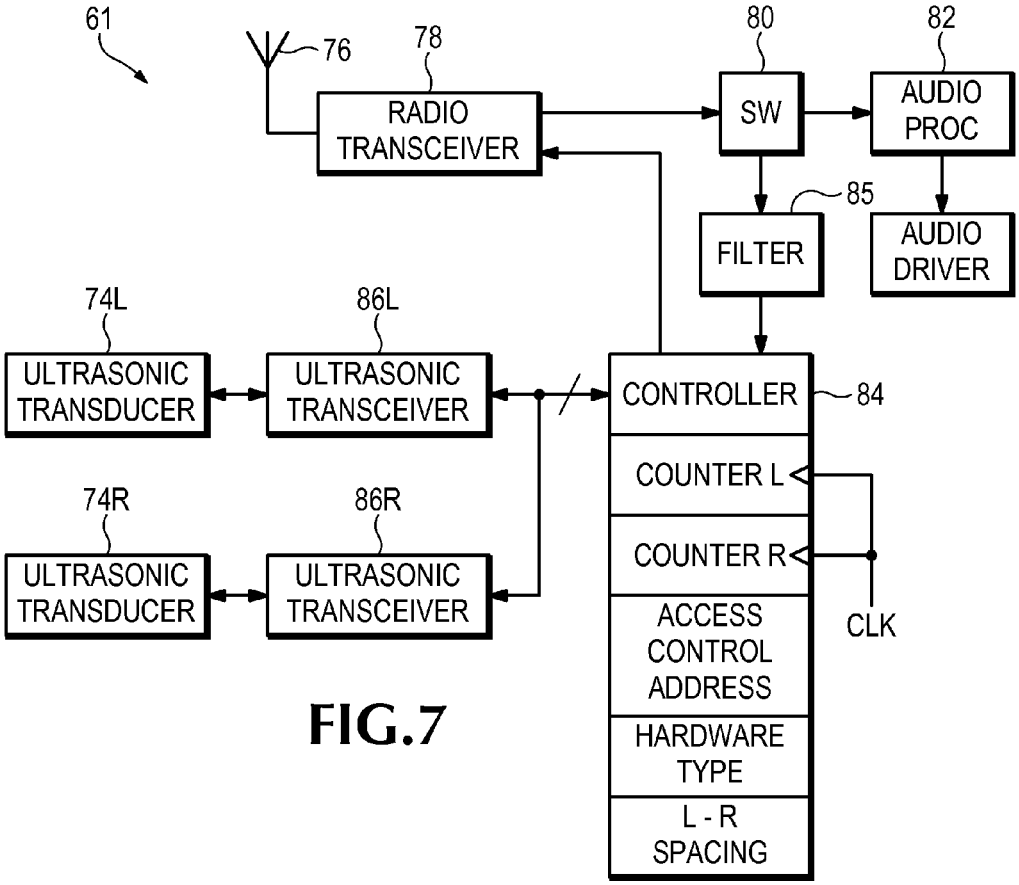
FIG. 7 is a schematic block diagram of an electronics package included in the speaker shown in FIG. 6.

Referring to FIGS. 6 and 7, the center speaker 61 is similar to the speaker 62 except that the center speaker 61 includes two electro-acoustic transducers 74L, 74R positioned to left and right respectively of the central axis of the speaker. The lines defining the centers of the respective angular ranges of sensitivity are equidistant horizontally from the central axis of the speaker. The transducers 74L, 74R are spaced apart horizontally by at least 10 cm, and preferably at least 15 cm.

The topology of the electronics package in the center speaker is similar to that shown in FIG. 5 except that there are two ultrasonic transceivers connected to the two ultrasonic transducers 74L, 74R respectively and the controller 84 includes two counters (L, R) that count clock pulses in similar fashion to the counter of the speaker 62 and store their respective counts in response to signals provided by the transceivers 86L and 86R respectively.

The subwoofer 68 is similar to the speaker 62. The topology of the electronics package in the subwoofer is similar to that shown in FIG. 5 except that, for a reason mentioned below, it is not necessary for the controller to include a counter.

Each speaker has a unique access control address, similar in function to the MAC address assigned to a network adapter, and also has a hardware type. The three hardware types are center, surround and subwoofer. The access control address and hardware type are hard-wired into the controller 84 at time of manufacture. The center speaker also has a unique speaker ID, which is both hard-wired into the controller and recorded on a plate attached to the center speaker. The horizontal spacing of the transducers 74L, 74R is also hard-wired into the controller 84, for example as supplementary field to the hardware type. Other items of speaker-specific information may also be stored in the controller at time of manufacture.

The speakers are slave modules relative to the master module 4. When the home theater system is first installed and connected to a source of operating current, and before the decoder unit is switched on for the first time, the master module contains no information regarding the speakers. When the home theater system is connected to a source of operating current, and before the decoder unit is switched on, the master module operates in a low power condition in which its radio transceiver 28 periodically monitors each of its communication channels to determine whether the channel is clear for transmission. The master module maintains a list of the channels that are clear and updates that list as necessary.

Similarly, the electronics packages of the speakers operate in a low power condition in which the audio processor and ultrasonic transceiver are off and at intervals of 500 ms the controller 84 turns the radio transceiver 78 on and scans all possible channels in an attempt to detect a signal from a master module that is organizing or running a network. If the speaker does not detect a master module organizing or running a network, the controller turns the transceiver 78 off.

The system remains in this low power condition until a user switches the home theater system on, for example by pressing the power button on the remote control unit. In this event, the main processor 12 detects the POWER ON signal emitted by the remote control unit and issues a command to the internal components of the decoder unit to initiate a POWER ON routine. The master module 4 also receives this command from the main processor and selects, at random, a clear communication channel and transmits a beacon for about one second. The speakers that are within range (and are scanning all possible channels at intervals of 500 ms) are thereby informed that the master module is organizing a network and respond to the beacon by turning on their ultrasonic transceivers 86. The audio processor 82 of the speaker remains off.

During this initial phase of operation, the switch 80 directs signals received from the transceiver 78 to the message filter 85. The message filter 85, when operational, passes control messages that include the access control address of the speaker to the controller 84 and blocks other control messages from reaching the controller 84. However, at this point in operation, the message filter is not operational and all control messages transmitted by the master module are communicated to the controller 84.

After transmitting the beacon, the master module transmits a discovery command and then switches its radio transceiver to the receive mode for a brief interval of, for example, 64 ms. Each speaker selects at random a hold off time less than 64 ms and transmits a response to the discovery command at the end of the selected hold off time. The response contains the access control address of the speaker and the hardware type of the speaker. The master module stores a table containing the access control addresses and hardware types of the responding speakers in its non-volatile memory 40. For speakers other than the subwoofer, the table is also able to store one or more distance values, a left or right indicator, a front, fill or rear indicator, and at least one set of coordinates specifying speaker position. For the center speaker, the table stores a value for the distance between the left and right transducers.

Since the speakers select the hold off time at random, there is a possibility that two or more speakers will select the same hold off time. In order to guard against this possibility, the master module repeats the discovery process and if it detects a response from one or more slave units that did not respond to the first execution of the discovery process, the master module adds the access control address and hardware type of each additional speaker to the table stored in its memory.

After responding to the discovery command, the message filter 85 becomes operational so that only messages that include the proper access control address are communicated to the controller 84.

If there is a similar home theater system in a neighboring room, it is possible that the discovery command transmitted by the master module will elicit a response from two or more center speakers, in which case the table of speakers stored by the master module in response to the discovery command will contain entries for two or more center speakers. If this is the case, the master module must exclude from the network that it is organizing every center speaker that is not in the same room as the master module. In order to identify a center speaker that is not in the master module's room, the controller 32 causes the transceiver 28 to transmit a reduced power probe signal addressed to each center speaker listed in the table. Each center speaker that receives the probe signal transmits a response message. If the master module still receives multiple response messages, it reduces its transmission power again and issues a further probe signal. The master module continues in this manner until it receives a response from only one center speaker, and the master module identifies this center speaker as a member of its network and deletes the entries for other center speakers from its table.

In the event that this procedure is unable to resolve ambiguity in the identification of the center speaker that should be included in the network that is being organized by the master module, the user may employ the decoder unit's user interface to select the center speaker by reference to the speaker ID.

The surround speakers that received the discovery command may include speakers other than the six speakers 62-67. Likewise, the discovery command may be received by one or more subwoofers outside the room containing the center speaker. The master module transmits a command message to the center speaker and all the surround speakers and subwoofers in its table. The center speaker responds to the message by issuing a ping from each of its ultrasonic transducers and the surround speakers and subwoofer(s) respond by enabling their ultrasonic transducers to receive the pings. The master module then issues a request message to which the surround speakers and subwoofer(s) respond by reporting whether they detected at least one of the pings.

Because the ping issued by the center speaker 61 contains very little energy, it is not detected by surround speakers or subwoofers outside the room containing the center speaker and therefore the only speakers that report having detected at least one ping are speakers in the same room as the master module. The master module updates its table by deleting any entries for speakers that did not respond to the ping.

It will be appreciated that checks might be desirable before deleting a speaker from the table, for example to ensure that a speaker that is temporarily hidden from the center speaker by a person moving about the room, is detected. Such checks are not necessary to an understanding of the subject matter disclosed in this application and will not be described further.

In this manner, the master module is able to determine the access control addresses of all eight speakers in its network and exclude from the network any speakers that are outside the room in which the master module is located, associate a hardware type with each speaker, and learn the distance between the left and right ultrasonic transducers of the center speaker. The master module must then determine the location (left or right and front, fill or rear) of each of the surround speakers. For proper operation of the home theater system, it is sufficient for the master module to determine that a subwoofer is in the same room as the center speaker. It is not necessary to determine the location of the subwoofer.

There are several ways in which the locations of the surround speakers can be determined.

In accordance with one approach, the master module executes an algorithm based on certain assumptions regarding the layout of the home theater system. In accordance with these assumptions, the central axes of the left and right fill speakers are perpendicular to the central axis of the center speaker and the listening position is located on the central axis of the center speaker and midway between the central axes of the left and right fill speakers. Referring to FIG. 2, the listening area is divided into four quadrants relative to a polar coordinate system centered at the default listening position and having the 0° vector aligned with the central axis of the center speaker. The front left quadrant is from 0° to 90°, rear left is from 90° to 180°, rear right is from 180° to 270° and front right is from 270° to 0°.

In order to facilitate discussion, it is convenient to specify an (X,Y) coordinate system in which the default listening position is at the origin (0,0), the right speakers are at positive X positions, the left speakers are at negative X positions, the front speakers are at positive Y positions and the rear speakers are at negative Y positions. See FIG. 2.

The master module selects one of the surround speakers and transmits a command message to which the selected surround speaker responds by issuing a ping and the center speaker responds by resetting its counters to zero. Each transducer of the center speaker detects the ping and the controller 84 stores the counts attained by the two counters. The master module interrogates the center speaker and the center speaker reports the stored count values. The master module repeats this operation for each of the other surround speakers in turn and thereby acquires a dataset that relates the access control address of the selected speaker (which issued the ping) and the two count values reported by the center speaker. As mentioned previously, the angle of sensitivity of the transducers typically exceeds 180° and accordingly the transducers of the center speaker 61 and the transducers of the speakers 62 and 67 are mutually acoustically visible in the layout shown in FIG. 2. If, in an alternative layout, the center speaker 61 is significantly closer to the listening position along the Y axis than the front speakers, an alternative triangulation technique may be used to determine the positions of the front speakers, for example utilizing the transducers of the rear speakers.

The master module is able to calculate the respective distances of the left and right transducers of the center speaker from each surround speaker. Since the distance between the transducers of the center speaker is known, it is then a routine matter for the master module to calculate the position of each surround speaker in the (X,Y) coordinate system.

Using the calculated (X,Y) positions of the speakers, the master module assigns each speaker to a speaker location (front left, right rear, etc.), by identifying the quadrants within which the speakers are located. It will be appreciated that this may result in some ambiguity. For example, both speakers 62 and 63 are located in the front right quadrant. This ambiguity can be resolved later, e.g. by use of triangulation to measure the Y locations of the speakers 62, 63 and 64 and inferring that the speaker 63, being between the speakers 62 and 64, must be the right fill speaker. It will also be appreciated that a greater error is associated with calculation of the Y positions of the front speakers than with calculation of the Y positions of the rear speakers, and it may therefore be desirable to recalculate the positions of the front speakers utilizing pings transmitted by the transducers of the rear speakers.

In this manner, the master module associates each speaker's access control address with a speaker location. The master module then transmits a message that associates the speaker's access control address with the I2S bus channel assigned to that speaker location, as discussed in greater detail below.

When the master module has associated each speaker with a speaker location and has calculated the distance of each speaker from the center speaker, the master module is able to calculate the position of each speaker in the (X,Y) coordinate system by triangulation, i.e. by using a ping emitted by the transducer of the right fill speaker to measure the distance between the right fill speaker and the front left and rear left speakers. By iteratively calculating speaker positions, the master module can calculate the positions of the surround speakers with substantial precision and accuracy.

Current 7.1 channel home theater decoders create the seven main speaker signals based on the locations of the main speakers in a polar coordinate system (r,θ) in which listening location is at the origin. By default, the right fill and left fill speakers are at 90° and 270° respectively and the center speaker is at 0°. The front and rear speakers also have default angular positions. The master module transforms the positions of the surround speakers in the (X,Y) coordinate system to the polar coordinate system (r,θ). The master module supplies the (r,θ) values for the main speakers to the home theater decoder 14 via the main processor 12.

The home theater decoder uses the r values and the calculated (or default) angular positions in processing the audio data received from the signal source to produce the seven surround signals, so that the center signal and the six surround signals received at the default listening location are in the proper phase relationship.

Set up of the home theater system is now almost complete. Referring again to FIG. 3, the main processor communicates certain user commands to the home theater decoder 14, which receives digital audio data from the signal source 2. The home theater decoder 14 creates eight audio signals assigned to the eight speaker positions respectively from the digital audio data and the (r,θ) information for the main speakers and combines the eight signals in four pairs, as described above, and outputs four I2S serial data streams, each conveying the digital audio signals for two speakers. Although the I2S bus frame provides 32 bits for each channel, in a practical implementation, 24 of the 32 bits are used for each channel and the remaining 8 bits are null. The four serial data streams are received by the master module 4.

The master module includes a deserializer 18 that separates each of the I2S signals into its two components and a matrix 20 that assigns each of the resulting eight digital audio signals to respective slots (slots 0-7) in a transmission multiplex.

Different home theater decoders employ different mappings between speaker position and the channels of the I2S buses. The matrix 20 maps the I2S bus channels to the slots to provide a fixed relationship between speaker position and slot. For example, regardless of the mappings of speaker positions to I2S bus channels, the matrix may be configured to assign the right front speaker signal to slot 0. Thus, the message that associates each speaker's access control address with an I2S channel informs the speaker whose access control address is associated with the right front speaker position that it should capture the digital audio signal transmitted in slot 0.

At this point, the home theater system is operative. The controller 32 enables the radio transceiver 28 to transmit the digital audio signal provided by the matrix 20. The matrix 20 supplies a signal block, containing the data bits of eight consecutive slots, to the radio transceiver 28, which transmits the eight digital audio signals. The digital audio signal is organized as a succession of blocks, each of which contains the data for eight slots representing one sample value for each speaker. The radio transceiver 28 employs the digital audio signal to encode a carrier at the frequency of the selected communication channel and transmits the modulated signal via the antenna 24. In each speaker, the controller 84 sets the switch 80 to direct the signal received from the radio transceiver to the audio processor 82. The controller also provides the audio processor with the appropriate slot ID. The audio processor 82 receives the audio data blocks from the radio transceiver 78, captures the audio data for the appropriate slot, converts the digital audio signal to analog form, amplifies the audio signal and supplies the audio signal to the audio driver.

Each slot of the signal transmitted by the matrix contains 24 bits. A noise event may impair the receipt of several consecutive bits. In order to reduce the impact of such a noise event on the signal provided to any one speaker, the output signal block transmitted by the matrix may be scrambled so that, for example, no two consecutive bits of the transmitted signal are of the same slot and higher order bits are interleaved with lower order bits.

Since it is possible that the actual listening location will in fact be different from the default listening location, it is desirable that the master module be able to calculate the (r,θ) positions of the center speaker and surround speakers relative to the actual listening location. In order to support this autofind (AF) functionality, the remote control unit 11 includes an ultrasonic transducer and an ultrasonic transceiver.

In order to execute the listening location AF calculation, the user, seated at the listening location, presses an AF button on the remote control unit and the infrared transmitter of the remote control unit issues an IR command that is received by the main processor. The main processor 12 decodes the IR message and determines it to be an AF command, and responds by sending an AF command to the master module 4. The master module transmits an AF command over the radio. The AF command contains the access control address of the center speaker and instructs the center speaker to transmit a ping signal by each of its transducers. The center speaker and the left and right fill speakers restart their counters and the left and right fill speakers listen for the pings transmitted by the left and right transducers of the center speaker. When the left or right fill speaker receives a ping from the center speaker, it saves the count value and restarts its counter. The remote control unit also listens for a ping from the center speaker. Upon receiving a ping, the remote control unit waits a set period that is sufficient for all echoes of the center speaker's pings to have decayed so that they are no longer detectable, say 100 ms, and then transmits a ping. The center speaker and the left and right fill speakers receive the second ping. The left and right fill speakers add the count value (since the restart) to the count value saved for the ping transmitted by the center speaker. The center speaker saves the two left and right count values. The master module then reads all these values and uses them (and the set wait period of the remote control unit) to triangulate the position of the remote control unit in the (X,Y) coordinate system. Knowing the (X,Y) position of the listening location relative to the center speaker, the master module can transform the (X,Y) locations of the main speakers to (r,θ) locations relative to the listening location.

In the case of the embodiment described above, delaying the audio signals to take account of distance of the main speakers from the listening location is performed by the home theater decoder when it creates the digital audio signals. In other embodiments, the audio signals may be delayed elsewhere, for example in the main module or in the individual speakers. Amplification of the audio signals in response to adjustment of a volume control on the remote control unit is accomplished by the home theater decoder but in other embodiments, the amplification may be performed in the individual speakers either in the digital domain or in the analog domain by supplying suitable control messages to the speakers.

A less sophisticated home theater decoder may create the seven main speaker signals based only on the distance of each of the main speakers from a default listening location that is between the two fill speakers and directly in front of the center speaker (and based on default angular positions of the speakers). Since the locations of the main speakers in the (X,Y) coordinate system are known, it is straightforward to calculate the distance of each main speaker from the default listening location.

In the case of a home theater system including such a less sophisticated home theater decoder, the master module supplies the distance values to the home theater decoder and the home theater decoder uses the distance values to calculate an appropriate set of delay times. The home theater decoder delays the individual audio signals for the seven main speakers based on the respective delay times.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. For example, the subject matter disclosed in this application has been described with reference to a home theater system having eight speakers but it will be appreciated by those skilled in the art that equivalent subject matter may be applied to a system having as few as two speakers and to systems having more than eight speakers. In addition, although the method of identifying speakers, in a system having a center speaker, a left speaker, and a right speaker, has been described in terms of the ping signals being emitted by the transducers of the surround speakers and detected by the transducers of the center speaker, it would alternatively be possible for the ping signals to be emitted by the transducers of the center speaker and received by the transducers of the surround speakers.

In the case of the described embodiment of the disclosed subject matter, the system is able to distinguish between the left and right sides of the listening area by virtue of the two transducers of the center speaker preferring the left and right sides respectively, in the sense that the left transducer, for example, receives a ping from a surround speaker on the left of the listening area before the right transducer does so, and a surround speaker on the left side of the listening area receives a ping from the left transducer of the center speaker with a shorter delay than that with which it receives a ping from the right transducer. However, there are other mechanisms by which the system may be able to distinguish between the left and right sides of the listening area. For example, the two transducers of the center speaker may prefer the left and right sides of the listening area by virtue of their being angularly oriented so that one transducer transmits and receives preferentially to and from the right of the central axis of center speaker and the other transducer transmits and receives preferentially to and from the left of the central axis of the center speaker.

Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A method of identifying speakers in an array comprising a center speaker, a left speaker, and a right speaker, the method comprising:

providing the center speaker with left and right ultrasonic electro-acoustic transducers, providing the left speaker and the right speaker each with an ultrasonic electro-acoustic transducer, and either (a) energizing one ultrasonic electro-acoustic transducer of the center speaker to emit an ultrasonic acoustic ping signal, utilizing the transducers of the left and right speakers to detect the ping signal, measuring lapse of time between emission of the ping signal by said one ultrasonic electro-acoustic transducer and detection of the ping signal by the ultrasonic electro-acoustic transducers of the left and right speakers, energizing the other ultrasonic electro-acoustic transducer of the center speaker to emit an ultrasonic acoustic ping signal, utilizing the ultrasonic electro-acoustic transducers of the left and right speakers to detect the ping signal, and measuring lapse of time between emission of the ping signal by said other ultrasonic electro-acoustic transducer and detection of the ping signal by the ultrasonic electro-acoustic transducers of the left and right speakers, or (b) energizing the ultrasonic electro-acoustic transducer of the left speaker to emit an ultrasonic acoustic ping signal, utilizing the ultrasonic electro-acoustic transducers of the center speaker to detect the ping signal, measuring lapse of time between emission of the ping signal by the ultrasonic electro-acoustic transducer of the left speaker and detection of the ping signal by the ultrasonic electro-acoustic transducers of the center speaker, energizing the ultrasonic electro-acoustic transducer of the right speaker to emit an ultrasonic acoustic ping signal, utilizing the ultrasonic electro-acoustic transducers of the center speaker to detect the ping signal, and measuring lapse of time between emission of the ping signal by the ultrasonic electro-acoustic transducer of the right speaker and detection of the ping signal by the ultrasonic electro-acoustic transducers of the center speakers, and employing the measured values of lapse of time to assign a location to each of the left and right speakers relative to the center speaker.

2. A method according to claim 1, wherein the left and right ultrasonic electro-acoustic transducers of the center speaker are spaced horizontally, to left and right respectively of a centerline of the center speaker, and the step of employing the measured values of lapse time comprises either, in the case of alternative (a) calculating difference in the measured lapse of time between emission of the ping signal by said one ultrasonic electro-acoustic transducer and detection of the ping signal by the ultrasonic electro-acoustic transducers of the left and right speakers and calculating difference in the measured lapse of time between emission of the ping signal by said other ultrasonic electro-acoustic transducer and detection of the ping signal by the ultrasonic electro-acoustic transducers of the left and right speakers or, in the case of alternative (b) calculating difference in the measured lapse of time between emission of the ping signal by the ultrasonic electro-acoustic transducer of the left speaker and detection of the ping signal by the left and right ultrasonic electro-acoustic transducers respectively of the center speaker and calculating difference in the measured lapse of time between emission of the ping signal by the ultrasonic electro-acoustic transducer of the right speaker and detection of the ping signal by the left and right ultrasonic electro-acoustic transducers respectively of the center speaker.

3. A method of identifying speakers in an array comprising a center speaker, multiple A speakers, and multiple B speakers, where one of A and B is left and the other of A and B is right, wherein the A speakers include a front A speaker that is the closest of the A speakers to the center speaker, the center speaker includes A and B ultrasonic electro-acoustic transducers and each of the A speakers and each of the B speakers includes an ultrasonic electro-acoustic transducer, wherein the A ultrasonic electro-acoustic transducer of the center speaker is closer than the B ultrasonic electro-acoustic transducer of the center speaker to at least one of the A speakers and the B ultrasonic electro-acoustic transducer of the center speaker is closer than the A ultrasonic electro-acoustic transducer of the center speaker to at least one of the B speakers, and the method includes energizing the A ultrasonic electro-acoustic transducer of the center speaker to emit an ultrasonic acoustic ping signal, utilizing the ultrasonic electro-acoustic transducers of the A speakers to detect the ping signal, and measuring lapse of time between emission of the ping signal by the A ultrasonic electro-acoustic transducer of the center speaker and detection of the ping signal by the ultrasonic electro-acoustic transducers of the A and B speakers and energizing the B ultrasonic electro-acoustic transducer of the center speaker to emit an ultrasonic acoustic ping signal, utilizing the ultrasonic electro-acoustic transducers of the A speakers to detect the ping signal, and measuring lapse of time between emission of the ping signal by the B ultrasonic electro-acoustic transducer of the center speaker and detection of the ping signal by the ultrasonic electro-acoustic transducers of the A and B speakers.

4. A method according to claim 3, further comprising positioning a portable location measurement device including an ultrasonic electro-acoustic transducer at a selected location and using the portable location measurement device to initiate a measurement procedure by which the ultrasonic electro-acoustic transducers of at least two speakers emit ultrasonic ping signals, the ultrasonic electro-acoustic transducer of the location measurement device detects the ultrasonic ping signals, and lapse of time between emission of the ping signal and detection of the ping signal by the ultrasonic electro-acoustic transducer of the location measurement device is measured, allowing calculation of the position of the measurement location device relative to the speakers.

5. A method according to claim 4, further comprising adjusting relative signal delays to the speakers to account for the position of the location measurement device.

6. A method according to claim 4, further comprising adjusting relative signal delay to at least one of said speakers to account for the position of the location measurement device.

7. A home theater system comprising:

a control unit including a radio transmitter for emitting wireless control signals and wireless left and right audio signals, a first speaker provided with an ultrasonic electro-acoustic transducer and with a first speaker control means for controlling the ultrasonic electro-acoustic transducer of the first speaker in response to wireless control signals received from the radio transmitter, and a second speaker provided with an ultrasonic electro-acoustic transducer and with a second speaker control means for controlling the ultrasonic electro-acoustic transducer of the second speaker in response to wireless control signals received from the radio transmitter, and wherein the control unit, the first speaker control means and the second speaker control means are programmed so that when one of the speakers is in a right location relative to a listening location and the other speaker is in a left location relative to the listening location, the control unit cooperates with the first speaker control means and the second speaker control means to determine distance between the first and second speakers, and the control unit transmits the wireless left and right audio signals to the left and right speakers respectively.

8. A home theater system according to claim 7, further comprising a center speaker provided with left and right ultrasonic electro-acoustic transducers and with a center speaker control means for controlling the left and right electro-acoustic transducers in response to wireless control signals received from the radio transmitter, and wherein the control unit, the center speaker control means, the first speaker control means and the second speaker control means are programmed so that when one of the first and second speakers is in a right surround location relative to the center speaker and the other of the first and second speakers is in a left surround location relative to the center speaker, the control unit cooperates with the center speaker control means, the first speaker control means and the second speaker control means to identify which of the first and second speakers is in the right surround location and which of the first and second speakers is in the left surround location, and the control unit transmits the wireless left and right audio signals to the speakers in the left and right surround locations respectively.

9. A home theater system according to claim 7, wherein the first speaker is a left speaker and the second speaker is a right speaker and the system further comprises a center speaker that includes left and right ultrasonic electro-acoustic transducers for emitting an ultrasonic ping signal, and the left and right ultrasonic electro-acoustic transducers are positioned so that the left transducer is closer than the right transducer to the left speaker and the right transducer is closer than the left transducer to the right speaker.

10. A home theater system according to claim 7, wherein the first and second speakers each include a radio receiver for receiving wireless control signals from the radio transmitter of the control unit.

11. A home theater system according to claim 10, wherein the radio transmitter of the control unit and the radio receiver of the first speaker are implemented as respective radio transceivers each of which is operable selectively as a radio transmitter and a radio receiver, the first speaker control means is programmed for operating the radio transceiver of the first speaker selectively as a receiver for receiving wireless control signals from the radio transceiver of the control unit and as a transmitter for emitting wireless message signals, and the control unit is programmed for operating the radio transceiver of the control unit selectively as a transmitter for transmitting wireless control signals and as a receiver for receiving wireless message signals from the radio transceiver of the first speaker.

12. A home theater system according to claim 7, wherein the first speaker control means controls the ultrasonic electro-acoustic transducer of the first speaker to emit ultrasonic acoustic signals, the second speaker control means controls the ultrasonic electro-acoustic transducer of the second speaker to detect ultrasonic acoustic signals, and the control unit cooperates with the first speaker control means and the second speaker control means to determine distance between the first and second speakers by measuring lapse of time between emission of an ultrasonic acoustic signal by the ultrasonic electro-acoustic transducer of the first speaker and detection of the ultrasonic acoustic signal by the ultrasonic electro-acoustic transducer of the second speaker.

13. A home theater system according to claim 7, wherein the first speaker control means controls the ultrasonic electro-acoustic transducer of the first speaker to emit ultrasonic acoustic signals and to detect ultrasonic acoustic signals, the second speaker control means controls the ultrasonic electro-acoustic transducer of the second speaker to emit ultrasonic acoustic signals and to detect ultrasonic acoustic signals, and the control unit cooperates with the first speaker control means and the second speaker control means to determine distance between the first and second speakers by measuring lapse of time between emission of a first ultrasonic acoustic signal by the electro-acoustic transducer of the first speaker and detection of the first ultrasonic acoustic signal by the electro-acoustic transducer of the second speaker and measuring lapse of time between emission of a second ultrasonic acoustic signal by the electro-acoustic transducer of the second speaker and detection of the second ultrasonic acoustic signal by the electro-acoustic transducer of the first speaker.

* * * * *